US005494153A

United States Patent [19]

Housman

[11] Patent Number: 5,494,153

[45] Date of Patent: Feb. 27, 1996

[54] MERCHANDIZING APPARATUS

[75] Inventor: Richard W. Housman, Santa Monica, Calif.

[73] Assignee: Twelve Signs, Incorporated, Los Angeles, Calif.

[21] Appl. No.: 322,622

[22] Filed: Oct. 13, 1994

[51] Int. Cl.[6] ..... B65D 51/00

[52] U.S. Cl. ..... 206/45.29; 206/45.28; 206/232; 40/312

[58] Field of Search ..... 206/44 B, 44.11, 206/45.28, 45.29, 232, 459.5; 40/312, 313

[56] References Cited

U.S. PATENT DOCUMENTS

| | | | |
|---|---|---|---|
| 1,128,052 | 2/1915 | Roy | 40/313 |
| 1,464,388 | 8/1923 | Lambert | 206/45.29 |
| 1,609,875 | 12/1926 | Hoge | 206/45.29 |
| 1,853,622 | 4/1932 | Kennedy | 206/232 |
| 2,322,849 | 6/1943 | Horr | 206/45.29 |
| 2,964,169 | 12/1960 | Brachman | 206/45.28 |
| 3,278,015 | 10/1966 | Bernstein | 206/232 |
| 4,756,409 | 7/1988 | Murray | 206/459.5 |
| 5,046,609 | 9/1991 | Mangini et al. | 206/459.5 |

FOREIGN PATENT DOCUMENTS

| | | | |
|---|---|---|---|
| 8182 | 5/1914 | United Kingdom | 206/45.28 |
| 376953 | 7/1932 | United Kingdom | 206/45.28 |

*Primary Examiner*—David T. Fidei
*Attorney, Agent, or Firm*—Robbins, Berliner & Carson

[57] ABSTRACT

A merchandizing apparatus has a box for containing one or more types of merchandise, a first panel for displaying merchandizing information relating to a first type of said merchandise, a second panel on said box, and a stack of slips attached to said second panel, each slip being removably attached to said stack and containing information associated with a second type of said merchandise.

11 Claims, 1 Drawing Sheet

FIG. 1
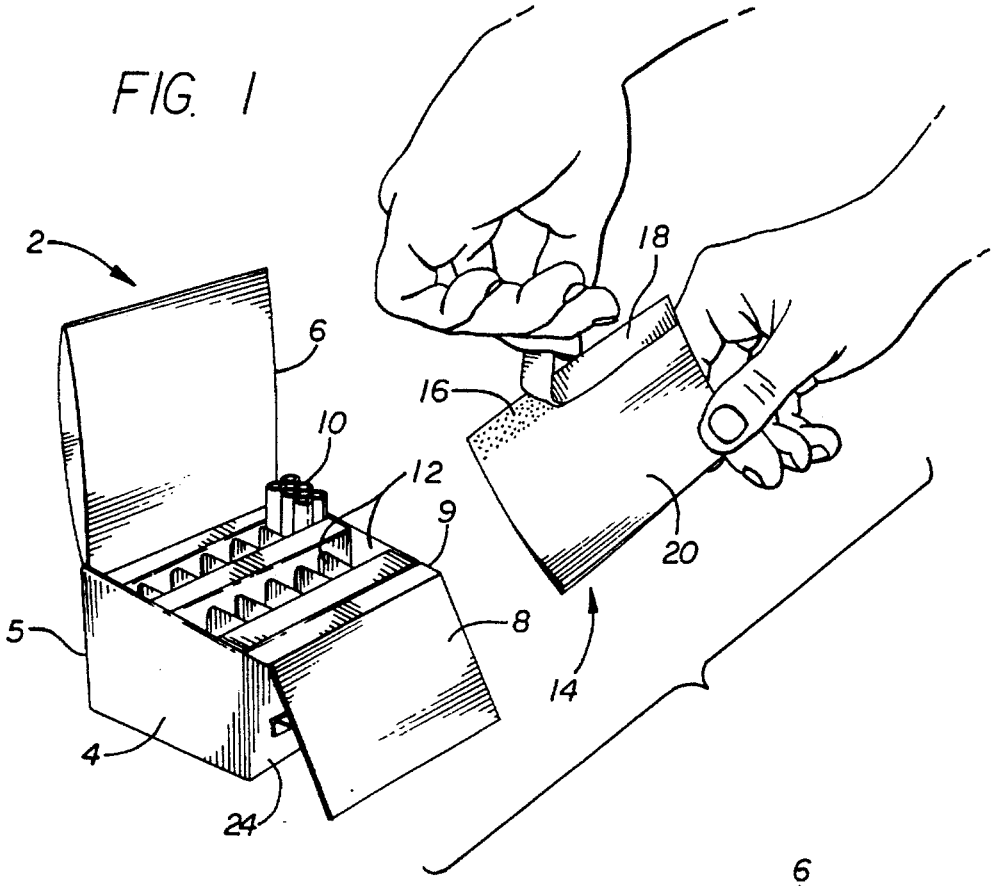
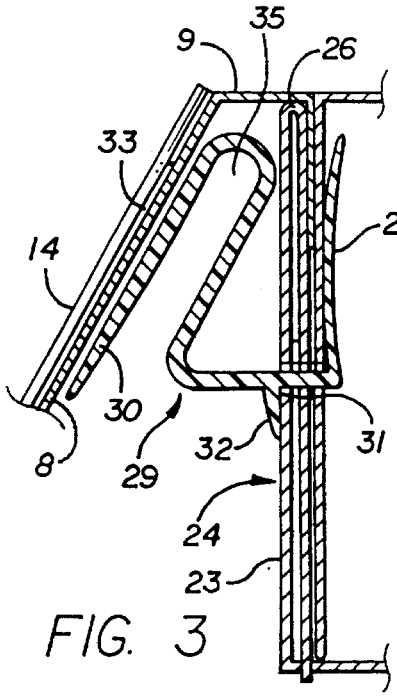
FIG. 3
FIG. 2
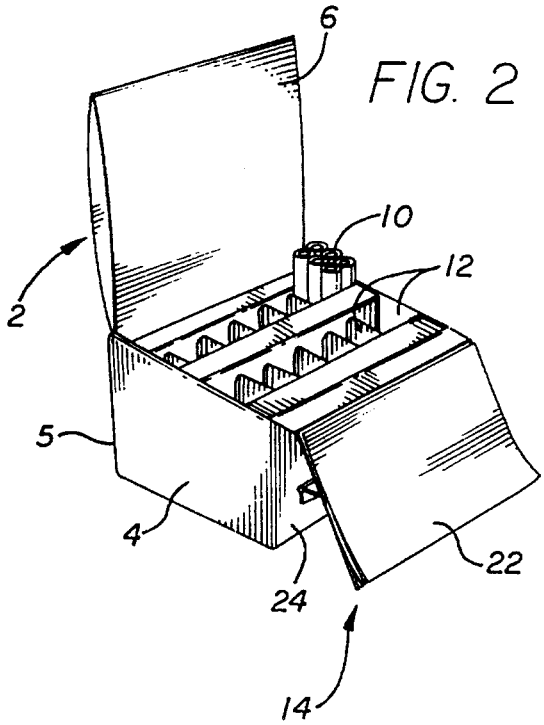

MERCHANDIZING APPARATUS

FIELD OF THE INVENTION

The present invention is related in general to a merchandizing apparatus.

BACKGROUND OF THE INVENTION

An important requirement of merchandizing is to be able to draw the attention of customers to the merchandise (as used herein, merchandise may either be a product or a service). Drawing the customers' attention to a merchandise is especially difficult when the merchandise is a service, because there is no shape, size and appearance which can be used to attract the customers to the service, and especially more so when the service has to be marketed among the many products being displayed and sold in the usually limited shelf space available in a store.

What is needed is a merchandizing apparatus and technique which can simultaneously attract customers to more than one type of merchandise.

What is also needed is a method and apparatus for facilitating merchandizing of a service in a store among different products.

What is also needed is a method and apparatus for merchandizing two types of merchandise simultaneously within a limited space which a store sets aside to merchandise one type of merchandise.

The present invention provides a merchandizing apparatus which has a box for containing a first type of merchandise, a first panel for displaying information relating to the first type of merchandise, a second panel on the box, and a stack of slips attached to the second panel. Each such slip is removably attached to the stack and contains information associated with a second type of merchandise.

In another aspect, the present invention also provides a method of dispensing advertising slips from a limited store space, each of the slips containing merchandizing information of a first type of merchandise. The method includes the step of placing a first type of merchandise in a box, the step of displaying merchandizing information relating to the second type of merchandise on a first panel which extends from the box, and the step of stacking the slips on a second panel extending from the box. The slips are stacked by removably adhering one slip to another slip.

In still another aspect, the present invention provides an apparatus for simultaneously marketing at least two types of merchandise. The apparatus has a container for a first type of merchandise. The apparatus also has a first panel, extending upward from a back surface of the container, which contains marketing information relating to the first type of merchandise. The apparatus also has a second panel, extending downward from a front surface of the container which serves as a billboard to which a stack of individually detachable slips are adhered. Each of the slips contains information relating to a second type of merchandise.

Advantageously, the present invention allows two products/services to be marketed effectively within the limited space generally available in a store. Also advantageously, the present invention facilitates the marketing of a service by marketing it with an associated product, using the product to help draw the attention of passersby.

BRIEF DESCRIPTION OF THE DRAWINGS

FIG. 1 is an exploded, perspective view of a container, a billboard and advertising slips in accordance with the present invention, showing application of the advertising slips to the billboard;

FIG. 2 is a perspective view of a container and a billboard to which the advertising slips are attached; and FIG. 3 is a cross-sectional view of the front panel and billboard of the box of FIG. 2 with the slips affixed.

DESCRIPTION OF THE PREFERRED EMBODIMENT

With reference to FIG. 1, there is shown an apparatus 2 for merchandising at least two types of merchandise, at least one of which may be either a product or a service. The apparatus 2 includes a box 4 which is used for containing and shipping a plurality of items of a first type of merchandise, which can be anything such as candies or toys. In this particular embodiment, however, the first type of merchandise are scrolls of horoscopes 10 contained in the box 4. An upright first panel 6, which can be formed by bending a lid of the box 4 into the back wall 5 after shipment of the box 4, extends upward from the back wall 5. The first panel 6 can be used as a display area for information and pictures to attract the attention of passersby to the items of merchandise 10 contained in the box 4. A second panel 8 extends from the front edge 9 of the box 4 to form what can be referred to as a billboard. The box 4 as has been described is not itself new, but has been previously used to display merchandise.

The billboard 8 of the box 4 provides a surface for placing a stack 14 of individually detachable slips 22 (i.e., pieces of paper) each of which contains information of a second type of merchandise (not shown). The back 20 of the stack 14 (i.e., the reverse side of the last slip) contains an adhesive 16 for attaching the stack 14 to the billboard 8. Since the stack 14 may be shipped separated from the box 4, a protective strip 18 is placed on top of the adhesive 16 to protect it during shipment. After the box 4 is installed in a store, the protective strip 18 is removed (see Figure 1) so that the stack 14 can be adhered to the second panel 8 as shown in FIG. 2.

The slips 22 of the stack 14 are adhered to each other at the top edges thereof with each slip 22 being individually detachable from the stack 14. To facilitate reading of the information displayed on the slips 22 and detachment of an individual slip 22 by a passerby, the billboard 8 extends at an angle with the vertical plane extending from the front wall 24 of the box 4. To support the billboard 8 at the angled position, a support 29 (see FIG. 3), such as a plastic clip, is placed between the billboard 8 and the front wall 24 of the box 4. The support 29 has an inner support 28 which is inserted into the box 4 through a hole 31 on the front wall 24, as well as an outer support 30 for supporting the billboard 8. The front wall 24 is folded into several layers for reinforcement of the support 29. A base 32 is provided on the support 29 to anchor the support 29 against the exterior surface 23 of the front wall 24. An adhesive 33 can preferably be applied between the second panel 8 and the outer support 30 to eliminate or reduce possible movement of the billboard 8 caused when a slip 22 from the stack 14 is lifted and detached. Advantageously, an upwardly pointed saddle section 35 is also provided on the support 29, to secure it, for example, over the front rail (not shown) of a rack in a supermarket, against said possible movement. Such a support 29 is itself not new, but has been previously used to support the box 4 on a rack.

Preferably, the type of merchandise marketed by the slips 22 of the stack 14 is associated with (i.e., in the same general interest or merchandising area as) the first type of merchandise 10 and the marketing information displayed on the first panel 6. In one application of the present invention, the items of the first type of merchandise 10 are scrolls of horoscopes placed in twelve cells 12 formed in the box 4. The first panel 6 displays information and pictures intended to draw the attention of passersby to the scrolls. The slips 22 in the stack 14 contain a telephone number of one or more astrologers for providing dial-up astrology information.

In effect, the display on the first panel 6 provides a first level of attraction to attract passersby who are interested in the first type of merchandise 10 (i.e., the horoscope scrolls). The display on the first panel 6 and the scrolls 10 in turn provide a second level of attraction to attract those who have interest in astrology to the second type of merchandise (i.e., dial-up astrology information). In effect, two types of merchandise can be marketed within the limited space available in a store. This is very important in view of the usually limited availability of shelf space in a store. Yet another advantage of the present invention is the ability to market an intangible type of merchandise, i.e., a service (the dial-up astrology information) with the help of a tangible product (the scrolls). Still another advantage of the present invention is that the front side of each slip 22 in the stack 14 can be used to provide a second display to further attract passersby to the first type of merchandise 10, with the sales information (for example, the phone number, address, and/or prices) related to the second type of merchandise being written on the reverse side of the slip 22. In other words, a synergistic effect is produced by the present invention.

The above embodiment is described for the purposes of illustrating the present invention. It will be understood that certain modifications and changes may be made thereto without departing from the spirit of the invention which is defined by the following claims.

What is claimed is

1. In a merchandizing apparatus, comprising a box for containing a plurality of a first type of merchandise, a first panel for displaying merchandizing information relating to said first type of merchandise, and a second panel on said box, the improvement comprising:

a stack of slips attached to said second panel, each slip being removably attached to said stack and containing information associated with a second type of merchandise.

2. A merchandizing apparatus as in claim 1, wherein said second panel extends angularly from a substantially vertical wall of said box to form a billboard thereon.

3. A merchandizing apparatus as in claim 1, wherein said first panel extends substantially vertically upward from a back wall of said box and said second panel extends downward angularly from a vertical plane to form a billboard thereon.

4. A merchandizing apparatus as in claim 1, wherein each of said slips has a front side having a picture relating to said first and second types of merchandise and a reverse side containing ordering information of said second type of merchandise.

5. A method for dispensing merchandising slips from a limited store space, comprising the steps of:

placing a product in a box;

displaying merchandizing information relating to said product on a first panel extending from said box;

attaching a stack of said slips to a second panel extending from said box, said slips being stacked by removably adhering one slip to another slip.

6. A method as in claim 5, wherein said slips are stacked at an angle with a vertical plane to form a billboard thereon.

7. A method as in claim 5, wherein said slips merchandise a service.

8. An apparatus for simultaneously marketing at least two types of merchandise, comprising:

a container for a first type of merchandise;

a first panel extending upwardly from a back surface of said container, said panel containing marketing information relating to said first type of merchandise;

a second panel extending downwardly from a front surface of said container; and a stack of individually detachable slips adhered to said second panel, each of said slips containing information relating to a second type of merchandise.

9. An apparatus as in claim 8, wherein said second panel extends from a front wall of said container.

10. An apparatus as in claim 8, wherein said stack of individually detachable slips are adhered together at a top edge of the slips.

11. An apparatus as in claim 8, wherein said stack is adhered at a top edge to the second panel.

* * * * *